US007017497B1

(12) United States Patent
Gardner, Jr.

(10) Patent No.: US 7,017,497 B1
(45) Date of Patent: Mar. 28, 2006

(54) METHOD FOR MAKING PAINTBALLS

(75) Inventor: William M. Gardner, Jr., Loyalhanna, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 0 days.

(21) Appl. No.: 11/015,710

(22) Filed: Dec. 16, 2004

Related U.S. Application Data

(60) Provisional application No. 60/532,166, filed on Dec. 22, 2003.

(51) Int. Cl.

| | |
|---|---|
| ***F42B 10/00*** | (2006.01) |
| ***F42B 12/00*** | (2006.01) |
| ***F42B 12/38*** | (2006.01) |
| ***F42B 12/40*** | (2006.01) |
| ***F42B 30/00*** | (2006.01) |

(52) U.S. Cl. ..... 102/513; 102/502

(58) Field of Classification Search ..... 43/1; 102/502, 513

See application file for complete search history.

(56) References Cited

U.S. PATENT DOCUMENTS

| | | | | |
|---|---|---|---|---|
| 2,318,718 | A | 5/1943 | Scherer | |
| 5,448,951 | A | 9/1995 | Olson | 102/513 |
| 6,543,365 | B1 * | 4/2003 | Vasel et al. | 102/502 |

* cited by examiner

*Primary Examiner*—Michael Carone
*Assistant Examiner*—Gabriel J. Klein
(74) *Attorney, Agent, or Firm*—Marger Johnson & McCollom

(57) ABSTRACT

A paintball is preferably formed by forming a quantity of filling material into a desired shape and then freezing the shaped filling material. A shell material is preferably applied to the frozen filling material.

20 Claims, 4 Drawing Sheets

METHOD FOR MAKING PAINTBALLS

This application claims priority from U.S. Provisional Application Ser. No. 60/532,166 filed Dec. 22, 2003.

BACKGROUND OF THE INVENTION

This invention relates generally to methods of manufacturing paintballs. More specifically, this invention relates to a method for manufacturing paintballs having improved characteristics and lower cost.

Paintball is a sport in which opposing individuals or teams attempt to eliminate their opponents by marking them with paint-filled projectiles ("paintballs") fired from pneumatic markers (or "paintball guns"). Modern paintballs are dye-filled gelatin capsules approximately 0.68 inches in diameter. The dye is typically a colored vegetable oil or similar substance that can be washed from the clothes and body of the players.

Conventional methods of manufacturing paintballs include the use of rotating dies (see, e.g., U.S. Pat. No. 2,318,718) and injection molding (see, e.g., U.S. Pat. No. 5,448,951). Paintballs manufactured according to these methods generally include a seam around the circumference of the paintball. This seam can result in a poor fit between the paintball and a barrel used to launch the paintball. The seam can also result in poor flight characteristics for the paintball when launched from the barrel. The diameters of paintballs manufactured according to these conventional methods are also frequently inconsistent ball to ball. Conventional paintball manufacturing techniques are also fairly expensive. Paintballs today generally cost around five cents or more per paintball. As the sport has evolved, players are able to shoot paintballs more rapidly and may expend as many as 2,000 or more paintballs in a single fifteen-minute game. For these reasons, and others, it is therefore desirable to have a method of making paintballs that results in a more consistent paintball size and shape and that also results in a less expensive paintball.

SUMMARY OF THE INVENTION

According to a preferred embodiment of the present invention, a method of making paintballs preferably includes forming a paintball filling material into a spherical, near spherical, or other desired shape, freezing the paintball filling material, and then applying a paintball coating (or shell material) to the filling material while in the frozen state.

This can be accomplished in a number of different ways, all of which fall within the contemplated scope of the present invention. For instance, the paintball filling material can be measured and dropped through a vacuum chamber. As the measured quantity of paintball filling material drops through the vacuum chamber, it forms into a sphere. This spherical drop of paintball filling material is then preferably frozen rapidly to maintain its shape. The paintball filling material can alternatively be supplied to a spherical mold and then frozen while in the mold. Any other method of forming the fill material into a sphere and then freezing it is also acceptable and within the contemplation of this invention.

Once frozen, the paintball filling material is then preferably coated with a shell material. This can be accomplished, for instance, by spraying a shell material onto the paintball filling material, by dipping the filling material into a bath of shell material, by pouring the shell material over the filling material, or in any other of a number of ways which will be apparent to those of skill in the art.

The foregoing and other features and advantages of the invention will become more readily apparent from the following detailed description of the invention which proceeds with reference to the accompanying drawings.

DETAILED DESCRIPTION

Figure 1:
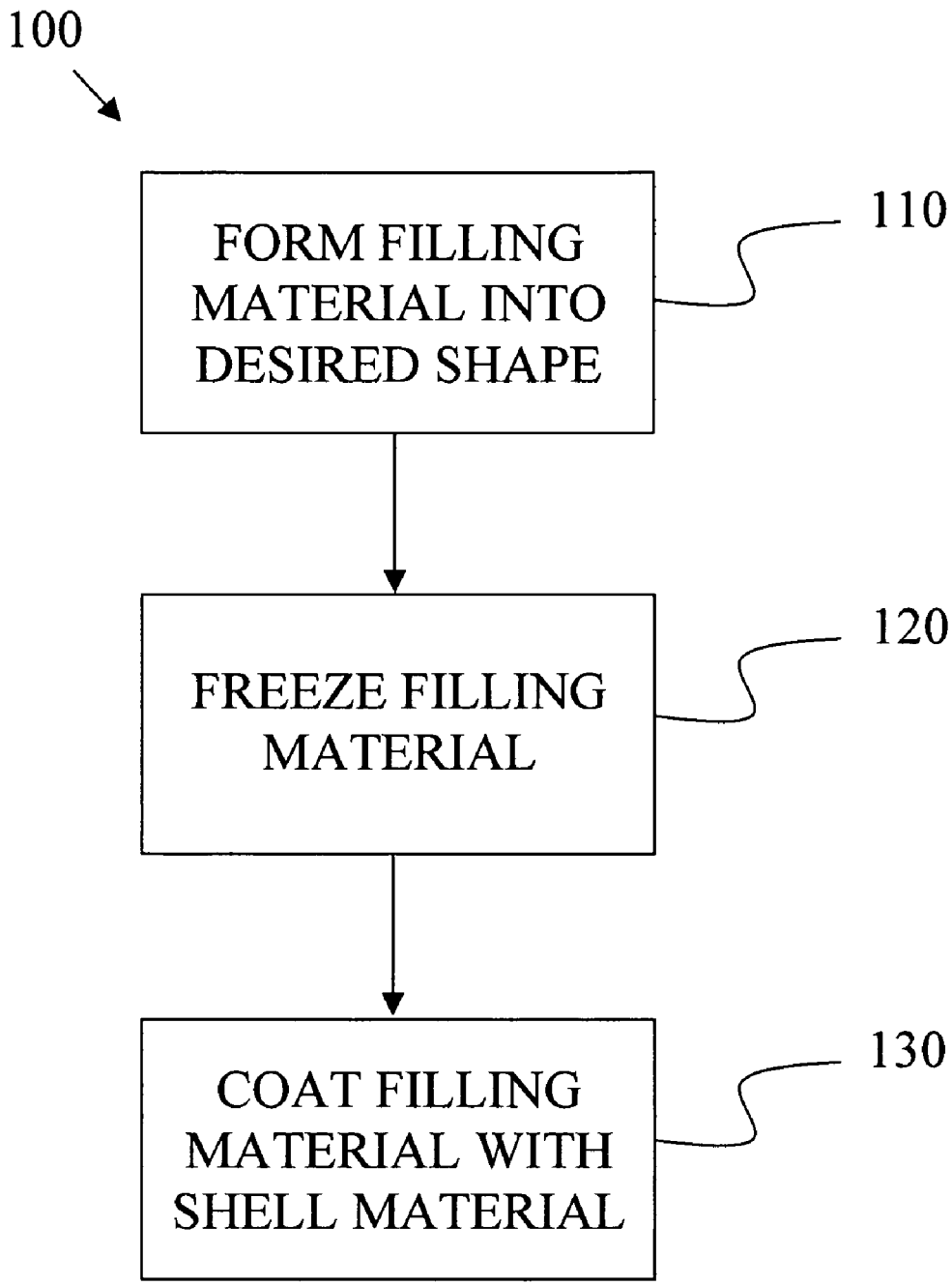
FIG. 1 is a flow chart illustrating a process for making paintballs according to one embodiment of the present invention.

Referring to FIG. 1, a process 100 for making paintballs according to one embodiment of the present invention includes forming paintball filling material into a spherical or near-spherical shape (or other shape, as desired) 110, freezing the filling material 120, and then coating the frozen filling material with a shell material 130. This process 100 will now be described in greater detail with reference to the embodiment illustrated in FIGS. 2–4.

Figure 2:
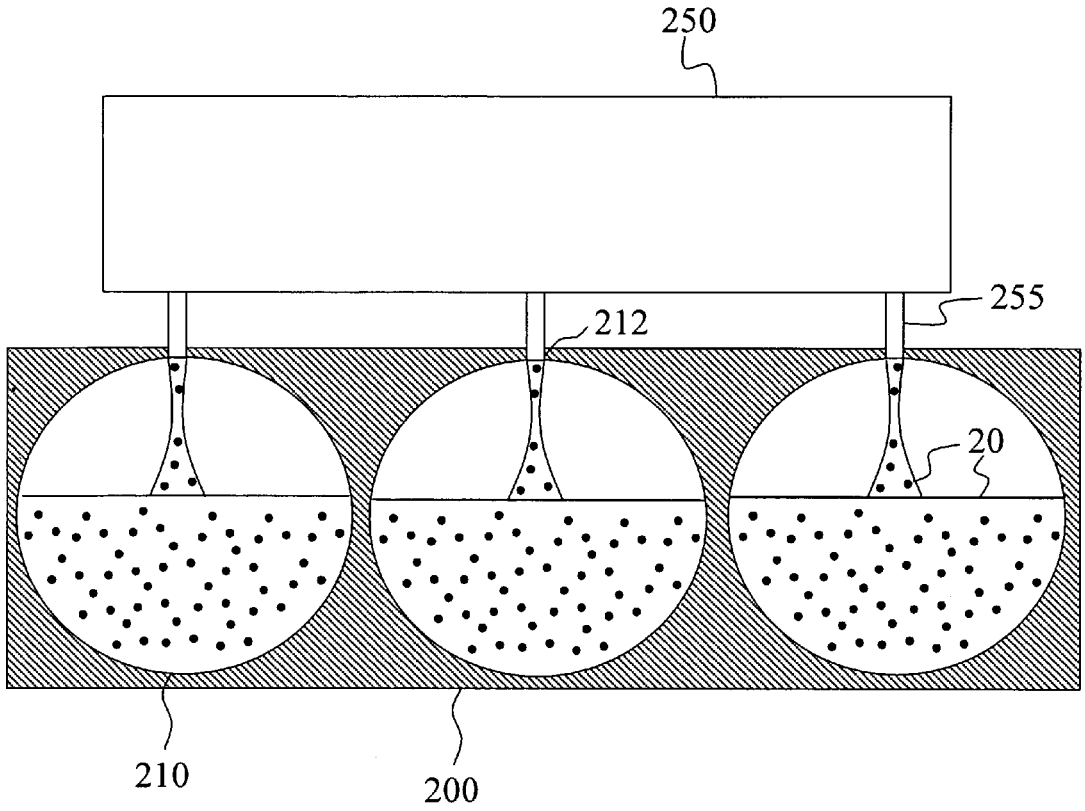
FIG. 2 is a schematic diagram illustrating one embodiment of a process of forming a quantity of paintball filling material into a spherical shape, according to the process of FIG. 1.

Referring first to FIG. 2, according to one embodiment of this invention, a mold 200 is prepared having a plurality of cavities 210 having a spherical or other desired shape. The cavities are preferably sized to give the final projectile, after coating with shell material, the desired size. For paintballs, the desired size is approximately 0.68 inches in diameter.

The mold 200 can be provided with one or more openings 212 configured to receive filling material 20 from a filling apparatus 250. The filling apparatus 250 preferably includes one or more filling tubes 255 for filling the mold cavities 210 with a desired quantity of filling material 20. The expansion characteristics of the filling material 20 during freezing should be taken into account in determining the quantity of filling material 20 to be supplied to each cavity. The quantity of filling material 20 supplied to each cavity 210 is preferably an amount that will completely, or nearly completely fill the volume of the mold cavity 210 upon freezing of the filling material 20.

In an alternative embodiment, a quantity of paintball filling material can be measured and released into a vacuum chamber. As the filling material falls through the vacuum chamber, it forms into a spherical (or near spherical) shape. The quantity of filling material is preferably selected to give the projectile the desired size after freezing and application of the shell material. Once the filling material has formed into a spherical shape, either by molding, through use of a vacuum chamber, or in any other way capable of forming the desired quantity of filling material into its desired shape, the filling material is then frozen to retain its shape.

Figure 3:
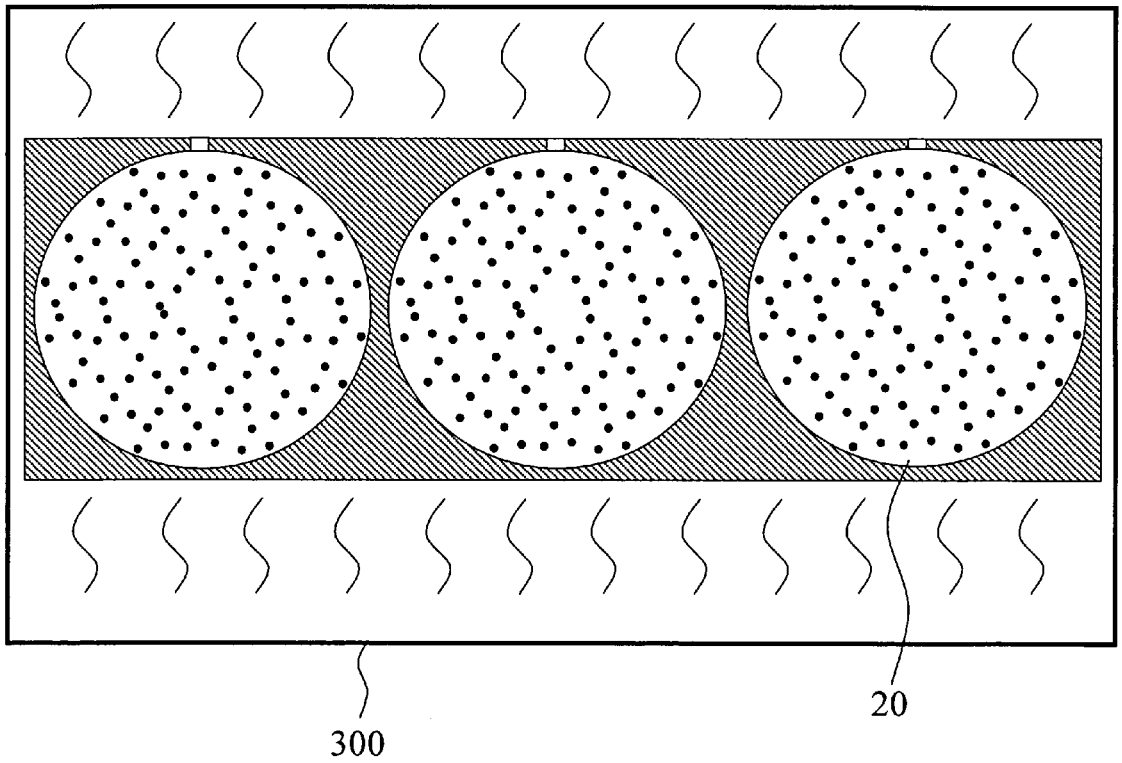
FIG. 3 is a schematic diagram illustrating one embodiment of a process of freezing the spherical-shaped paintball filling material, in the process of FIG. 1.

Referring to FIG. 3, the mold 200 of FIG. 2 is preferably passed through a freezing chamber 300 to cause the molded filling material 20 to freeze in its desired shape. The temperature of the freezing chamber 300 and the time in which the mold 200 is retained in the freezing chamber 300 can be selected to give the filling material the desired shape for the desired length of time to complete the manufacturing process.

In the case of the vacuum chamber formed balls of filling material, this can be accomplished, for instance, by dropping the paintball filling material through a chamber having a temperature low enough to cause the filling material to freeze rapidly. Any other method of freezing the paintball filling material while allowing it to maintain the desired shape are also contemplated as being within the scope of the present invention.

When the filling material has been frozen in its desired shape, a shell material is then applied to the frozen filling material. The shell material is preferably a gelatin material, such as used in conventional paintball manufacturing processes, but can be any other material suitable for this use including plastic or other materials. The shell material can alternatively be applied in a number of different ways within the scope of this invention.

Figure 4:
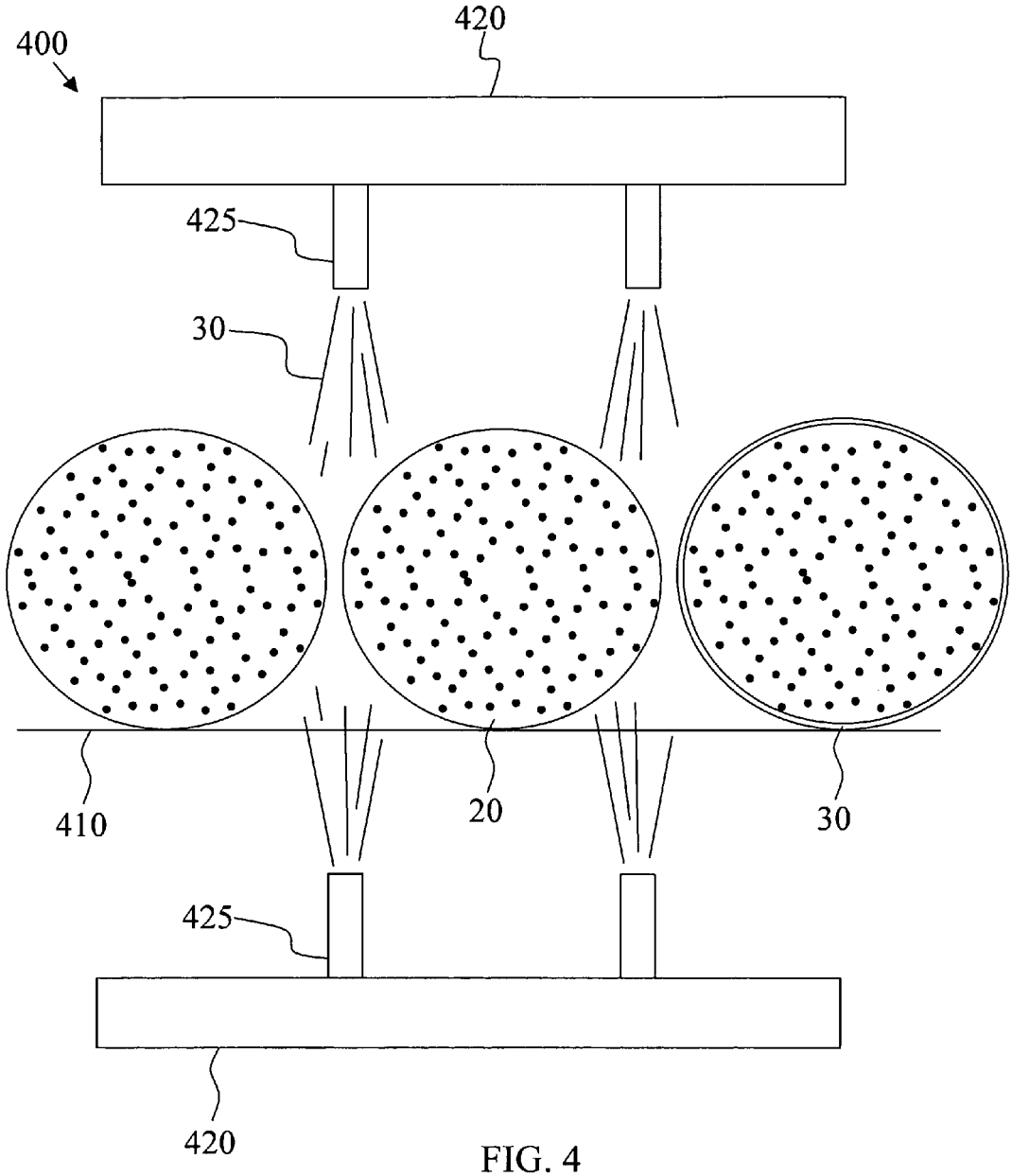
FIG. 4 is a schematic diagram illustrating one embodiment of a process of coating the frozen, spherical-shaped paintball filling material with shell material, according to the process of FIG. 3.

In the embodiment illustrated in FIG. 4, the shell material 30 is sprayed onto the frozen paintball filling material 20 in a spray chamber 400. In this case, the frozen filling material 20 is arranged on a permeable conveyor 410 (such as a wire, plastic, or cloth mesh conveyor belt) and is passed through the spray chamber 400. As the frozen paintball material 20 passes through the spray chamber 400, shell material 30 is applied to the paintball material 20. The temperature, viscosity, and composition of the shell material 30 is preferably selected such that it will cure shortly after application to the frozen fill material 20.

The application of shell material 30 could also be done, for instance, by dropping the paintballs through a spray chamber. The shell material may be applied by dipping the frozen fill material in a bath of shell material or by pouring shell material over the frozen fill material.

After the shell material has been applied to the fill material, a finishing process can take place to help ensure that the projectile has the desired shape and size characteristics. The finishing process can include processing in a tumbler as well as further curing at a desired temperature.

Having described and illustrated the principles of the invention in a preferred embodiment and various alternative embodiments thereof, it should be apparent that the invention can be modified in arrangement and detail without departing from such principles. For instance, various steps of the process may be modified in arrangement, detail, and order, or may be omitted entirely, and still fall within the spirit and scope of this invention. We therefore claim all modifications and variations coming within the spirit and scope of the following claims.

What is claimed is:

1. A method of forming a paintball, said method comprising:

forming a quantity of paintball filling material into a desired shape;

freezing the paintball filling material; and applying a shell material to the frozen paintball filling material.

2. A method according to claim 1, wherein forming the quantity of paintball filling material into a desired shape, comprises forming the filling material into a sphere by dropping a measured quantity of paintball filling material through a vacuum chamber.

3. A method according to claim 2, wherein freezing the paintball filling material comprises dropping the paintball filling material through a freezing chamber in communication with the vacuum chamber.

4. A method according to claim 1, wherein applying a shell material to the paintball filling material comprises spraying the shell material onto the frozen paintball filling material.

5. A method according to claim 1, wherein the paintball filling material is molded into the desired shape.

6. A method according to claim 1, wherein applying a shell material to the paintball filling material comprises dipping the paintball filling material into a bath containing the shell material.

7. A method according to claim 1, wherein applying a shell material to the paintball filling material comprises pouring the shell material over the paintball filling material.

8. A method according to claim 1, further comprising measuring a quantity of paintball filling material before forming the quantity of paintball filling material into a desired shape.

9. A method according to claim 1, wherein forming a quantity of paintball filling material into a desired shape comprises pouring the paintball filling material into a mold cavity.

10. A method according to claim 1, further comprising curing the shell material.

11. A method of forming a paintball, said method comprising:

forming a desired quantity of paintball filling material into an approximately sphere-like shape;

hardening the sphere-like shaped paintball filling material; and applying a shell material to the hardened sphere-like shaped paintball filling material.

12. A method according to claim 11, wherein hardening the filling material comprises freezing the filling material.

13. A method of forming a paintball according to claim 11, wherein forming the desired quantity of paintball filling material into an approximately sphere-like shape comprises injecting the filling material into a spherical mold cavity.

14. A method of forming a paintball according to claim 11, wherein forming the desired quantity of paintball filling material into an approximately sphere-like shape comprises dropping the quantity of paintball filling material through a vacuum chamber.

15. A method of forming a paintball according to claim 14, wherein hardening the paintball filling material comprises flash freezing the paintball filling material in the vacuum chamber.

16. A method of forming a paintball, said method comprising:

dispensing a desired quantity of paintball filling material;

forming the desired quantity of paintball filling material into a desired shape;

freezing the paintball filling material having the desired shape to retain the desired shape and to provide a desired size; and applying a shell material to the frozen paintball filling material.

17. A method according to claim 16, wherein forming the desired quantity of paintball filling material into a desired shape comprises molding the paintball filling material into an approximately spherical shape.

18. A method according to claim 17, wherein the desired size is approximately 0.68 inches in diameter.

19. A method according to claim 16, wherein forming the desired quantity of paintball filling material into a desired shape comprises dropping the paintball filling material into a vacuum chamber.

20. A method according to claim 16, wherein the paintball filling material comprises vegetable oil and wherein the shell material comprises gelatin.

* * * * *